US009420860B2

(12) United States Patent
Jaffe

(10) Patent No.: US 9,420,860 B2
(45) Date of Patent: Aug. 23, 2016

(54) HAIR ACCESSORY AND JEWELRY ORGANIZER

(71) Applicant: Julianne R. Jaffe, Silver Spring, MD (US)

(72) Inventor: Julianne R. Jaffe, Silver Spring, MD (US)

( * ) Notice: Subject to any disclaimer, the term of this patent is extended or adjusted under 35 U.S.C. 154(b) by 22 days.

(21) Appl. No.: 14/317,623

(22) Filed: Jun. 27, 2014

(65) Prior Publication Data

US 2015/0001128 A1 Jan. 1, 2015

Related U.S. Application Data

(60) Provisional application No. 61/839,863, filed on Jun. 27, 2013.

(51) Int. Cl.
*A45C 11/16* (2006.01)
*A45D 44/02* (2006.01)

(52) U.S. Cl.
CPC ..... *A45C 11/16* (2013.01); *A45D 44/02* (2013.01); *Y10T 29/49826* (2015.01)

(58) Field of Classification Search
CPC ..... A47F 5/006; A45C 11/16; A45D 44/02; Y10T 29/49826
USPC ..... 206/581; 29/428
See application file for complete search history.

(56) References Cited

U.S. PATENT DOCUMENTS

| | | | | |
|---|---|---|---|---|
| 1,732,113 | A | 10/1929 | Van Der Meer | |
| 2,962,156 | A * | 11/1960 | Adams | A45C 11/16 206/559 |
| 3,997,050 | A * | 12/1976 | Patterson | A47F 7/02 206/566 |
| 4,632,474 | A * | 12/1986 | Ingersoll | A47F 7/02 312/125 |
| 4,850,658 | A | 7/1989 | Sandor | |
| 5,031,777 | A | 7/1991 | Knox | |
| 5,799,787 | A * | 9/1998 | Talbot | B25H 3/025 206/315.11 |
| 6,672,463 | B2 | 1/2004 | Dashefsky | |
| 7,891,506 | B2 | 2/2011 | Kornowski | |
| 2005/0218090 | A1 | 10/2005 | Sepanek | |
| 2012/0000812 | A1 | 1/2012 | Gunter et al. | |
| 2012/0305442 | A1 * | 12/2012 | Apodaca | A45D 33/006 206/581 |

* cited by examiner

*Primary Examiner* — Anthony Stashick
*Assistant Examiner* — James M Van Buskirk
(74) *Attorney, Agent, or Firm* — Daniel Eisenberg, Esq.

(57) ABSTRACT

A receptacle for storing and organizing hair accessories and jewelry items has a main body with rotatable base. The main body is formed from a plurality of contiguous columns. The columns are radially symmetrical about a vertical central axis, and one or more of the columns may include one or more compartments. The tops of the contiguous columns define the top of the main body and have a petal shape. The petal shaped tops define a central compartment between them. The central compartment includes a hinged lid connected proximate to its peripheral edge. The compartments may house various means of storing and organizing hair accessory and jewelry items. In a preferred embodiment, the top of the main body is shaped like a flower.

10 Claims, 12 Drawing Sheets

HAIR ACCESSORY AND JEWELRY ORGANIZER

CROSS-REFERENCE TO RELATED APPLICATIONS

This application claims the benefit of U.S. Provisional Application No. 61/839,863, filed Jun. 27, 2013, and entitled "Hair Accessory and Jewelry Organizer," the entire disclosure of which is incorporated herein by reference.

STATEMENT REGARDING FEDERALLY SPONSORED RESEARCH OR DEVELOPMENT

Not Applicable.

FIELD OF THE INVENTION

This invention relates to hair accessory and jewelry storage devices and organizers.

BACKGROUND OF THE INVENTION

Young girls and women often possess a large number of different hair accessories including barrettes, hair clips, pony tail holders, scrunchies, bobby pins, head bands, etc. Hair accessories often get stored loosely in bathroom, bedroom, kitchen and desk drawers, numerous boxes, or are left out on table surfaces and counters where they can easily be lost. Moreover, these items may be stored in multiple locations throughout the home. This often leads to frustration for an owner who wishes to mix and match various hair accessories or jewelry and cannot find the desired items when needed.

Various storage boxes are available to help an owner store and organize their hair accessories and jewelry, but these storage boxes are often designed for either jewelry, or hair accessories, but not both. All-purpose storage boxes and containers used to store various items (e.g. pencils, glue sticks, stickers, sewing supplies, etc.) are available, as are jewelry boxes that are specifically designed to hold jewelry. However these storage boxes are not well suited for storing and organizing hair accessories and jewelry together. In addition, many storage boxes are plain looking and tend to get stored in drawers, closets, or other out-of the way places and are rarely used again. There is therefore a need for a hair accessory and jewelry organizer that is attractive, practical, and fun to use for all ages.

SUMMARY OF THE INVENTION

A hair accessory and jewelry organizer includes a main body with a rotatable base. The main body has a plurality of contiguous cylindrical columns extending from the base. The tops of the contiguous cylindrical columns define a periphery of semicircular caps in the shape of flower petals and further define a central compartment. The semicircular caps and central compartment define the top of the main body. In a preferred embodiment, the top of the main body is shaped like a flower head.

One or more of the contiguous cylindrical columns include one or more compartments. A compartment may house drawers for storing hair accessories, such as barrettes, pony tail holders, scrunchies, hair clips, bobby pins, and the like. The drawers may also be used to store pieces of jewelry, or other similar items. The drawers may be supported by shelves or some other support means known in the art. A drawer may include a raised guide on its underside which slides along a corresponding groove in the supporting shelf to facilitate opening and closing the drawer in alignment with the guide. Each drawer may also include a handle. In a preferred embodiment, at least one of the cylindrical columns includes a stack of drawers.

A compartment in a cylindrical column may also house a vertical pole which extends from the floor of the compartment. The pole may be used to retain objects that can be looped around the pole, such as scrunchies, elastic bands, bracelets, or pony tail holders. In a preferred embodiment, at least one of the cylindrical columns includes such a pole.

A cylindrical column may also include a compartment that houses a plurality of hooks suspended from the ceiling of said compartment. The plurality of hooks may be used to hang hair accessories, such as those mentioned herein, or jewelry, such as bracelets, necklaces, rings, or other pieces. Alternatively hooks may be attached to one or more interior walls of a cylindrical column. In a preferred embodiment, at least one of the cylindrical columns includes hooks.

A cylindrical column may also be solid or hollow with no usable compartment. The column may have a cushioned felt material affixed to its outer surface. In addition, the felt column may feature a plurality of elastic bands wrapped around it which can be used to retain various hair accessories or jewelry items. Hair clips, hair pins and other hair accessories can be secured to the elastic bands. In one embodiment, an elastic band includes holes spaced along the band for hanging earrings, pins, or the like. In a preferred embodiment, at least one of the cylindrical columns has a cushioned felt material covering. The felt covered column of the preferred embodiment further includes the aforesaid elastic bands for holding hair accessories or jewelry against the cushioned felt exterior of the column.

A cylindrical column may also include a compartment that houses stackable shelves for storing and organizing various hair accessories or jewelry items. The shelves may be adjustable, so that the space between shelves can be increased or decreased. Any number of shelves may be housed in a compartment as long as they fit, and the shelves may be removable or permanently installed in the compartment.

It should be understood that any one of the contiguous cylindrical columns of the main body may house any combination of the aforesaid hooks, pegs, pole, shelves, or drawers.

The top central compartment of the main body may be used to store hair bands, scrunchies, pony tail holders, banana clips, or any other hair accessories. The central compartment may include a hinged lid attached proximate to the rim of the compartment. In one embodiment the hinged lid features a mirror affixed to its inner surface. The hinged lid may also include a finger catch for opening or closing the lid.

The rotatable base of the hair accessory and jewelry organizer rotates about a central vertical axis. The base may include two or more overlapping plates, such that one plate rotates clockwise or counter clockwise relative to a fixed plate. Any other means of rotating the base known in the art may also be utilized. One or more pads or grips may be affixed to the underside of the base. In one embodiment, four felt pads are affixed to the underside of the base. However any number of pads may be used and positioned in any configuration on the underside of the base. The pads may also be made of any suitable material, including rubber, cork, felt, fabric, etc.

DETAILED DESCRIPTION OF THE INVENTION

Figure 1:
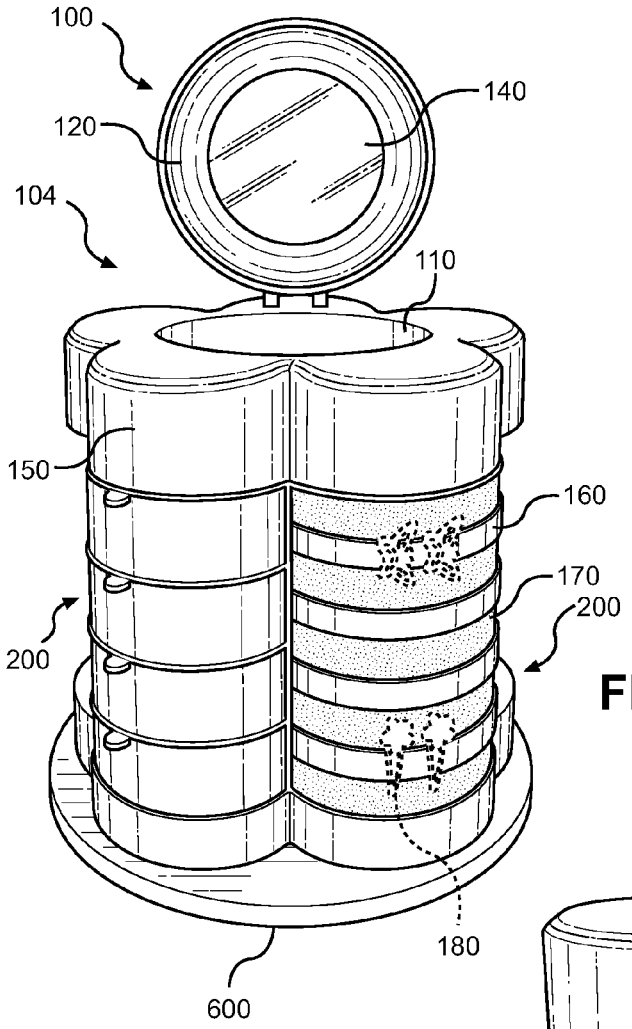
FIG. 1 is a front perspective view of the hair accessory and jewelry organizer according to an embodiment of the present invention.

This invention is directed to storage devices and organizers. More specifically, the invention is a hair accessory and jewelry organizer having a plurality of different compartments and shaped like a flower.

Referring to the figures generally, hair accessory and jewelry organizer 100 includes a rotatable base 600 with a plurality of contiguous columns extending therefrom. In a preferred embodiment the columns have a semi-cylindrical shape as shown in the figures, but one of ordinary skill in the art will appreciate that the columns may have a different shape that what is shown in the figures. For example, the columns may have a polygonal, or star shaped vertical cross-section, as opposed to a circular or semi-circular vertical cross-section. The columns are radially symmetrical about a vertical central axis and may include one or more chambers. The tops of the contiguous columns define the top of the main body and further define a periphery of semi-circular caps or petals. The term petal and semi-circular cap shall be regarded as equivalent terms for purposes of this application.

The radially symmetrical petals define a central compartment 110 between them. The central compartment is preferably circular, but may be a different geometric shape, such as a square, rectangle, triangle, or other polygon. The central compartment thus described is embedded in the top of the main body and is surrounded by the petals. The central chamber may have any suitable depth, but is preferably about two inches deep.

The central chamber includes a hinged lid 120 connected to the top of the main body. More specifically, the lid includes a horizontal hinge member 132. The horizontal hinge member 132 may include a through bore for receiving a hinge pin. The horizontal hinge member 132 is inserted between hinge anchors 134 mounted on a top surface of the main body, proximate the rim of central chamber 110. A hinge pin 136 is fitted in a tight passage formed when the through bore of the horizontal hinge member is coaxially aligned with the openings in anchors 134. Alternatively, the horizontal hinge member may be a solid member that clips into anchors 134, obviating the need for a hinge pin. In either case, the horizontal hinge member 132 rotates about a hinge axis. The hinge components described above form a hinge assembly 130 for the lid.

Alternatively, the lid may include a sleeve that clips onto a horizontal hinge member 132 disposed between hinge anchors 134. One of ordinary skill in the art will appreciate that the lid may be attached to the top of the main body in any suitable location that allows opening and closing the lid over the central chamber. The hinged lid may also include a mirror 140 affixed to the inner surface of the lid and a finger catch 124 for opening and closing the lid.

Figure 13:
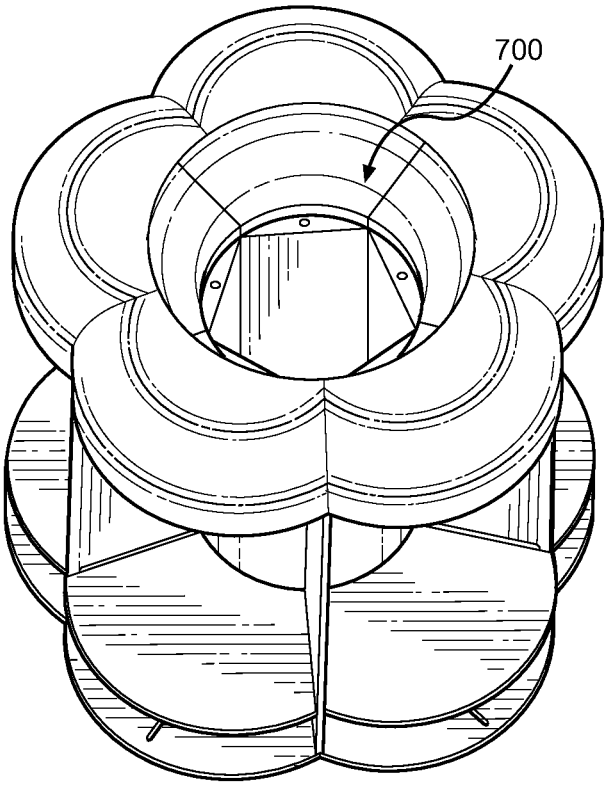
FIG. 13 is a top perspective view of the hair accessory and jewelry organizer according to an embodiment of the present invention.
Figure 14:
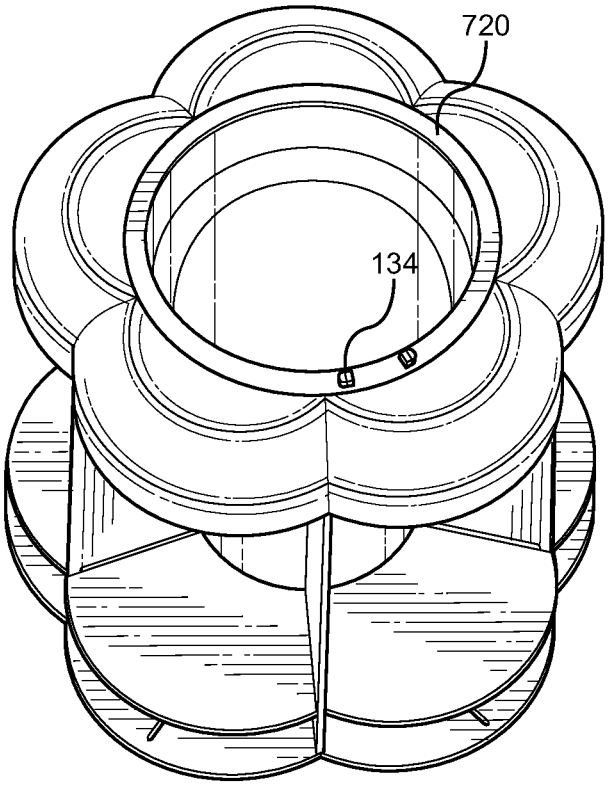
FIG. 14 is a top perspective view of the hair accessory and jewelry organizer according to an embodiment of the present invention.
Figure 15:
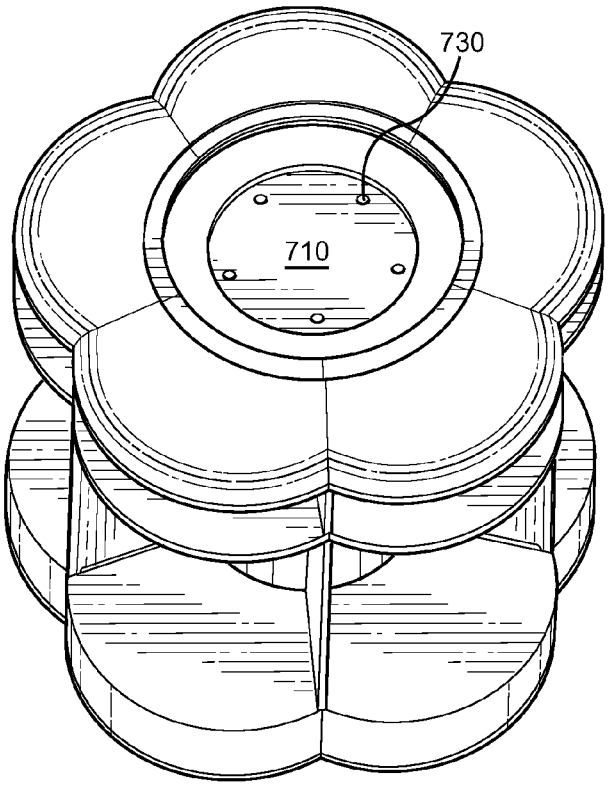
FIG. 15 is a bottom perspective view of the hair accessory and jewelry organizer according to an embodiment of the present invention.

According to another embodiment shown in FIGS. 13 and 14, a central cavity 700 defines a slot for receiving a removeable compartment module 720. As shown in FIG. 15, the compartment module 720 may be secured to the organizer by fastening the bottom of the module to the cavity floor 710. Any appropriate fastening means may be used to secure the compartment module to floor 710, such as screws, adhesive, or clips. Alternatively, the compartment module may be installed in the slot without securing it to floor 710. The compartment module 720 may also include one or more ridges on its outer surface that rotatably engage with complementary grooves along the sides of the slot. The compartment module can thus be screwed into the slot.

As shown in FIG. 13, the slot defined by central cavity 700 has a funnel shaped top and a pentagonal cavity bottom. The compartment module 720 is configured to fit snugly in the slot (i.e. it has a complementary external profile). However, one of ordinary skill in the art will appreciate that the slot and compartment module may have many different shapes, limited only by the slot being able to accommodate the compartment module.

According to the embodiment shown in FIG. 14, hinge anchors 134 are disposed on the rim surface of compartment module 720. Consequently, in this embodiment the top surface of the organizer is clear of any hinge components. The hinge anchors are configured to connect to a horizontal hinge member on lid 120 via hinge pin 136, thus forming a hinged lid attached to the compartment module.

As previously discussed herein, each of the petals 150 define the top of a contiguous column 200. Moreover, each of the columns may include one or more compartments disposed therein. The terms compartment and chamber shall be regarded as equivalent terms for purposes of this application. A compartment may house one or more drawers 220 for storing hair accessories, such as barrettes, pony tail holders, scrunchies, hair clips, bobby pins, and the like. The drawers may also be used to store pieces of jewelry, or other similar items.

Figure 2:
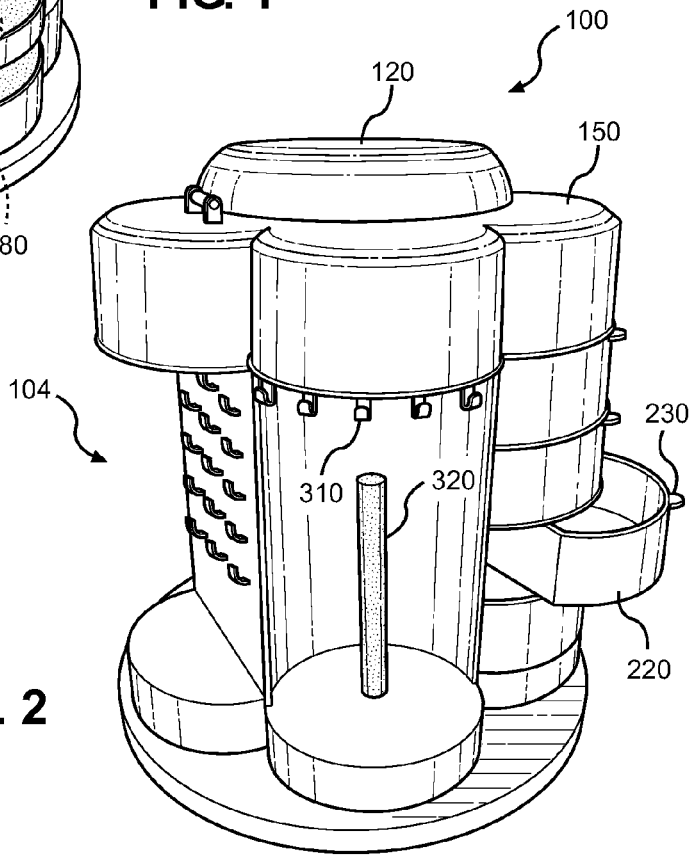
FIG. 2 is a side perspective view of the hair accessory and jewelry organizer according to an embodiment of the present invention.
Figure 3:
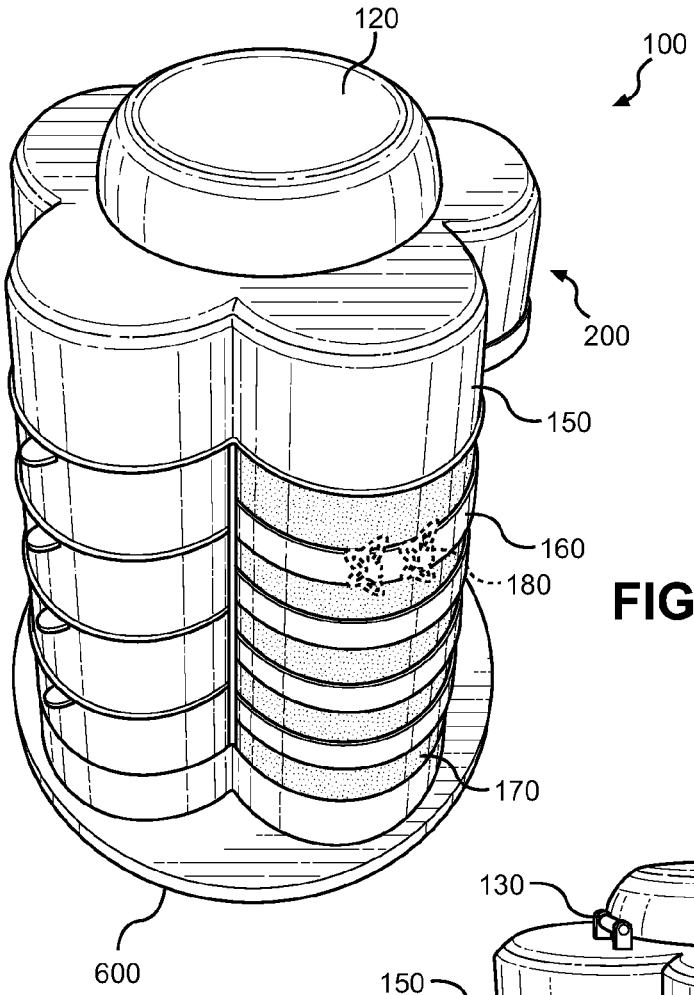
FIG. 3 is a top perspective view of the hair accessory and jewelry organizer according to an embodiment of the present invention.

The drawers may be supported by shelves, drawer slides, drawer tracks, or other support means known in the art. Each drawer may also include one or more raised guides on its undersurface wherein the guide slides along a corresponding groove in a supporting shelf to facilitate opening and closing the drawer in alignment with the guide. Each drawer may also include a handle 230. In a preferred embodiment, at least one of the cylindrical columns includes a stack of drawers as shown in FIGS. 1-3.

A compartment in a cylindrical column may also house a vertical pole 320 which extends from the floor of the compartment. The pole may be used to retain circular objects that can be looped around the pole, such as scrunchies, elastic bands, bracelets, or pony tail holders. In a preferred embodiment, at least one of the cylindrical columns includes such a pole.

Figure 10:
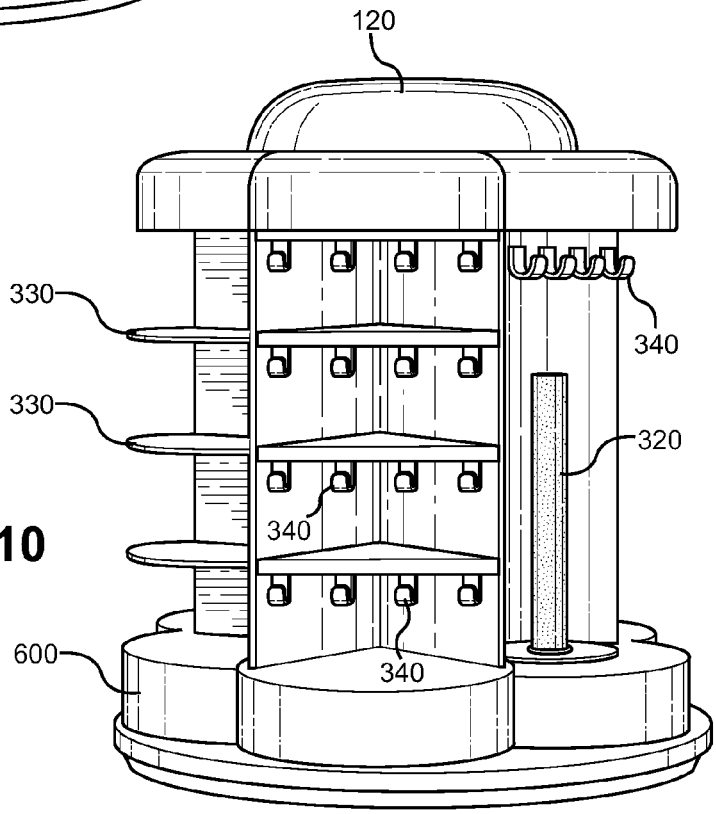
FIG. 10 is a rear perspective view of the hair accessory and jewelry organizer according to an embodiment of the present invention.

A cylindrical column may also include a compartment that houses a plurality of hooks suspended from the ceiling of said compartment. The plurality of hooks may be used to hang hair accessories, such as those mentioned herein, or jewelry, such as bracelets, necklaces, rings, or other pieces. Alternatively, hooks may be attached to one or more interior walls of a cylindrical column. In a further embodiment, hooks 340 hang down from the front of one or more shelves as shown in FIG. 10. In a preferred embodiment, at least one of the cylindrical columns includes hooks disposed therein.

A column 200 may be solid, hollow, or partially hollow and may be walled or partially walled. In a preferred embodiment, at least one of the columns has a cushioned felt covering 170. The felt covered column may include a plurality of elastic bands 160 wrapped around it which can be used to retain various hair accessories or jewelry items. Hair clips, hair pins and other hair accessories may be secured to the elastic bands. In one embodiment, at least one elastic band includes holes spaced along the band for hanging earrings, pins, or other items having a post or hook that fits through one of the holes. In a preferred embodiment, at least one of the columns is covered with a cushioned felt material. The felt-covered column of the preferred embodiment further includes the aforesaid elastic bands for holding hair accessories or jewelry against the cushioned felt exterior of the column.

Figure 8:
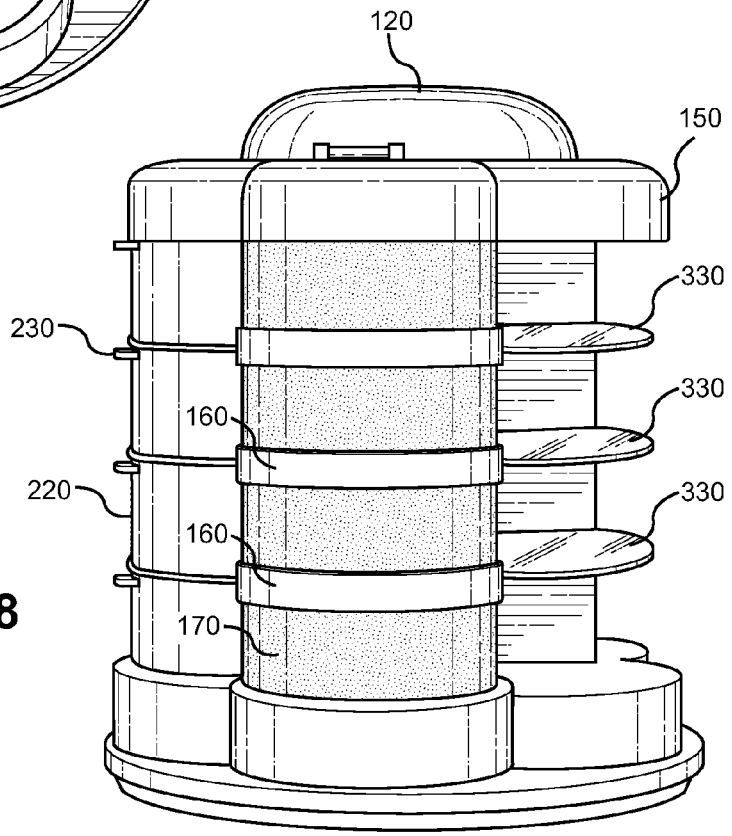
FIG. 8 is a rear perspective view of the hair accessory and jewelry organizer according to an embodiment of the present invention.

A column may also include a compartment that houses stackable shelves for storing and organizing various hair accessories or jewelry items as shown in FIGS. 8 and 10. The shelves may be adjustable, so that the space between shelves can be increased or decreased. Any number of shelves may be housed in a compartment as long as they fit, and the shelves may be removable or permanently installed in the compartment.

It should be understood that any one of the contiguous columns of the main body may house any combination of the aforesaid hooks, pegs, pole, shelves, or drawers.

The top central compartment 110 of the main body may be used to store hair bands, scrunchies, pony tail holders, or any other hair accessories or jewelry. The central compartment may include a hinged lid 120 attached to the top of the main body 104, proximate to the rim of the compartment. More specifically, the lid may include a horizontal hinge member 132. The horizontal hinge member 132 fits between hinge anchors 134 mounted on a top surface of the main body 104, proximate the rim of central chamber 110. A hinge pin 136 rotatably connects horizontal hinge member 132 to hinge anchors 134, allowing horizontal hinge member to rotate about a hinge axis formed by the hinge pin.

Alternatively, the lid may include a sleeve that clips onto a horizontal hinge member 132 disposed between hinge anchors 134. One of ordinary skill in the art will appreciate that the lid may be attached to the top of the main body 104 at any location that allows opening and closing the lid over the central chamber.

In one embodiment the hinged lid 120 also features a mirror 140 affixed to its inner surface. The hinged lid may further include a finger catch for opening or closing the lid.

The rotatable base 600 of the hair accessory and jewelry organizer rotates about a central vertical axis. According to an embodiment shown in FIG. 16, the rotatable base includes a turntable assembly 820 seated in a circular recess at the bottom of organizer 100. The turntable assembly may include two or more connected overlapping plates, where at least one plate can rotate relative to the other plate(s). For example, a turntable such as the one disclosed in U.S. Pat. No. 1,732,113 may be utilized. The entire contents of U.S. Pat. No. 1,732,113 are incorporated herein by reference. In the embodiment shown in FIG. 17, one side of the turntable assembly 540 is secured to a ring-shaped seat 810 inside the circular recess using adhesive, clips, press fitting, or fasteners well known in the art.

A platform 850 may be affixed to the other side of the turntable assembly using adhesive, clips, or fasteners well known in the art. The platform 850 attached to turntable 820 forms a rotatable base 600 for the organizer 100. Although the rotating base has been described in terms of a turntable assembly with attached platform, one of ordinary skill will appreciate that any other means of rotating the base known in the art may be utilized.

Figure 11:
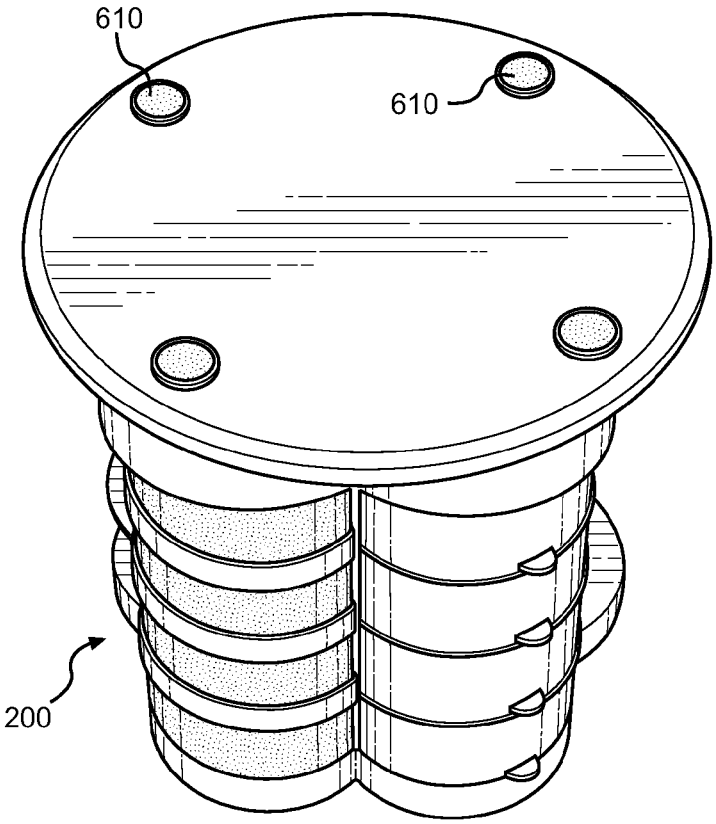
FIG. 11 is a bottom perspective view of the hair accessory and jewelry organizer according to an embodiment of the present invention.

One or more pads or grips may be affixed to the underside of the base. In one embodiment, four felt pads 610 are affixed to the underside of the base as shown in FIG. 11. However any number of pads may be used and positioned in any configuration on the underside of the base. The pads may also be made of any suitable material, including rubber, cork, felt, fabric, etc.

Turning to the Figures, FIG. 1 shows a hair accessory and jewelry organizer according to an embodiment of the present invention. The organizer includes a main body 104 with a rotatable base 600. The main body includes a plurality of contiguous columns 200 extending from the base. Each column may be solid, hollow, or may contain one or more compartments. In addition, a column may be fully or partially walled. In a partially walled state, the interior of the column is exposed as shown in FIG. 2.

The contiguous columns are radially symmetrical about a central vertical axis. In a preferred embodiment, one or more of the columns include one or more chambers for storing various hair accessory or jewelry items, such as scrunchies, barrettes, bobby pins, hair clips, hair bands, banana clips, elastic bands, ribbons, bows, and an assortment of jewelry items. The tops of the contiguous columns define the top of the main body and further define a periphery of semi-circular caps or petals 150. In one embodiment the semi-circular caps define a central chamber between them for storing hair accessory or jewelry items. However, a person of ordinary skill in the art will understand that any other appropriate items besides, or in addition to, hair accessory and jewelry items may be stored in this or any other chamber of the device. In a preferred embodiment, the periphery of caps and central chamber define a flower shape, giving the hair accessory and jewelry organizer an aesthetically pleasing, attractive look.

A hinged lid for the central chamber may be connected to hinge anchors 134. In a preferred embodiment shown in FIG. 14, the hinge anchors 134 protrude from the rim of compartment module 720. However, in an alternate embodiment the hinge anchors may be attached to a top surface of main body 104, proximate the rim of central compartment 110. The lid includes a horizontal hinge member 132, which is inserted between hinge anchors 134. A hinge pin 136 is then inserted through a tight passage, coaxial with hinge anchors 134 and horizontal hinge member 132. The horizontal hinge member rotates about the hinge axis formed by the hinge pin, and may rotate up to 180 degrees from a closed position. In a preferred embodiment the lid rotates at least 90 degrees from a closed position.

Alternatively, the lid may include a sleeve that clips onto a horizontal hinge member disposed between hinge anchors mounted on the top surface of the main body 104. One of ordinary skill in the art will appreciate that the lid may be attached to a horizontal hinge member positioned anywhere on the surface of main body 104, or on the rim of the compartment module, which allows opening and closing the lid over the central chamber 110 or compartment module 720.

FIG. 2 shows the organizer with two open or partially walled cylindrical columns. In one of the open cylindrical columns a vertical pole 320 extends from the floor for storing hair accessory and jewelry items. However, it should be understood that any number of columns may include such a pole. The vertical pole 320 may be used to store various hair accessory or jewelry items that can be looped around the pole. However, other appropriate items besides, or in addition to, hair accessory and jewelry items may be looped around the pole as well.

The open cylindrical column with vertical pole may also include hooks suspended from the ceiling of the column as shown in FIG. 2. The hooks may be attached directly to the ceiling of the chambered column, or may be attached to a strip that is attached to the ceiling. In addition, hooks may be attached to the walls of the chambered column.

In the preferred embodiment shown in FIG. 19, the hooks may be integrally formed as part of a plate 900 that attaches to the ceiling or other surface inside a cylindrical column. The plate may be attached to the surface using adhesive, clips, fasteners, or other attachment means known in the art. Alternatively, the plate may be inserted like a drawer into a grooved slot configured to receive the plate, at an appropriate position inside a column.

Another one of the cylindrical columns of FIG. 2 includes a stack of drawers. A drawer 220 may be pulled out as shown in FIG. 2 using drawer handle 230. Any number of drawers may be included in a cylindrical column, as long as they fit. Moreover, one of ordinary skill in the art will understand that one or more drawers may be included in any number of cylindrical columns. The drawers may be supported by shelves 330, such as those shown in FIG. 8. Each drawer may also include one or more guides on its undersurface that slides along one or more corresponding grooves in the shelf. The guide and mating groove help keep the drawers in alignment when pulled in and out. In a preferred embodiment, each drawer has one central guide on its bottom exterior surface that engages with a corresponding groove in the supporting shelf. The drawers may be used to store various hair accessories, jewelry, or other items.

FIG. 3 shows the hair accessory and jewelry organizer with closed cylindrical columns. In one embodiment, at least one of the cylindrical columns is filled with a stack of drawers as shown in FIG. 3. The closed drawers give the column a "closed" appearance, such that the interior of the column is not visible. FIG. 3 also shows a cylindrical column covered with cushioned felt 170. The felt covered column may be solid, hollow, or partly hollow. The cushioned felt provides a soft barrier between the column wall and an item being pressed against the column, as by the elastic bands 160 shown in FIG. 3. In a preferred embodiment one or more elastic bands are wrapped around at least one cylindrical column for the purpose of holding one or more hair accessory or jewelry items against the wall of the column. Hair accessories 180 may also be clipped onto, or hung from the elastic bands 160 as shown in FIG. 3.

Figure 4:
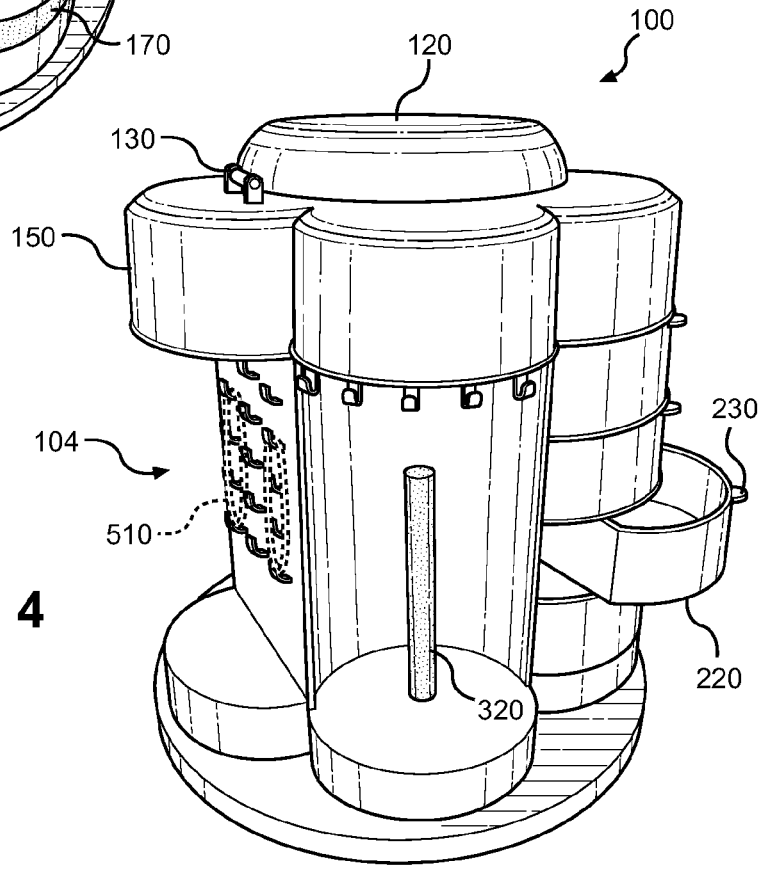
FIG. 4 is a side perspective view of the hair accessory and jewelry organizer according to an embodiment of the present invention.

FIG. 4 shows a hair accessory and jewelry organizer with two open or partially walled cylindrical columns, such that the interior of the chambered column is visible. One of the open columns shows hooks 510 attached to an interior wall for hanging various hair accessories, jewelry or other appropriate items. A plurality of such items is shown hanging from the wall mounted hooks 510 in FIG. 4. In addition, FIG. 4 shows hinged lid 120 covering central chamber 110. The hinge 130 includes a horizontal hinge member 132 connected to hinge anchors 134 via hinge pin 136. The horizontal hinge member 132 may be integrally formed as part of the lid. Hinge anchors 134 may be mounted on the top surface of main body 104, or may be integrally formed as part of the surface of main body 104, as through molding.

In the preferred embodiment shown in FIG. 14, hinge anchors 134 protrude from the rim of compartment module 720. In this embodiment the top surface of main body 104 is clear of any hinge components, such as hinge anchors 134. One of ordinary skill will further appreciate that hinge anchors 134 may be mounted or affixed to the compartment module rim, or may be a molded portion thereof.

Figure 5:
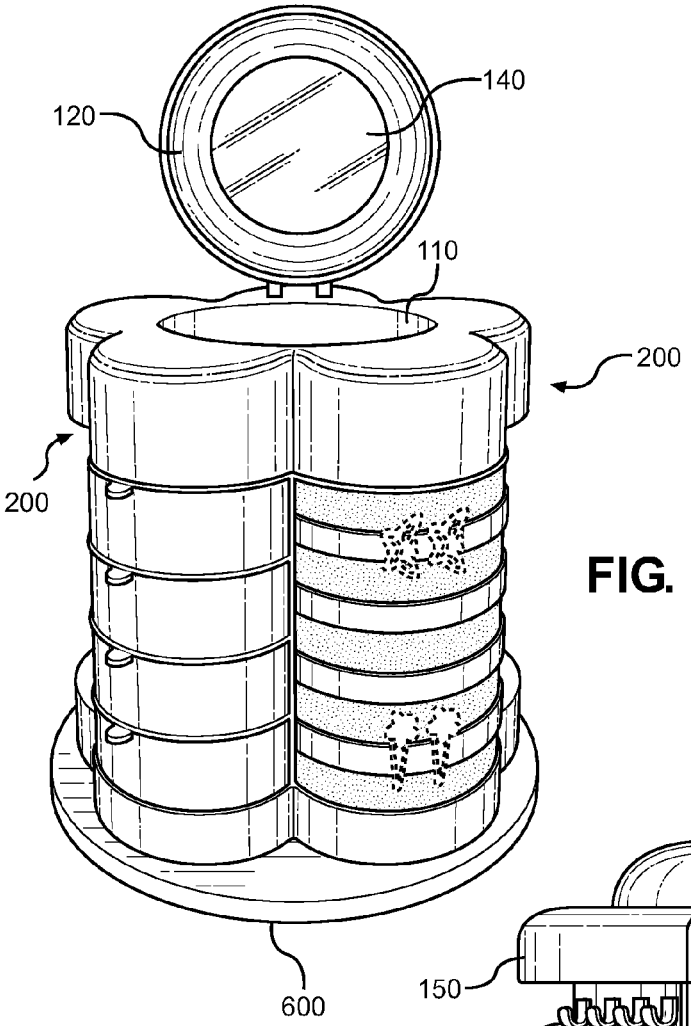
FIG. 5 is a front perspective view of the hair accessory and jewelry organizer according to an embodiment of the present invention.
Figure 6:
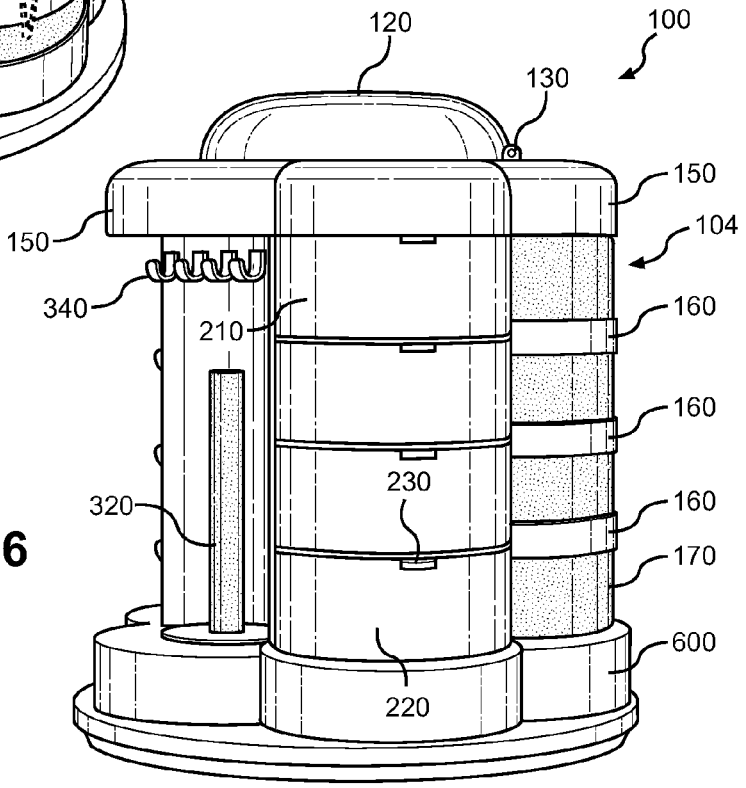
FIG. 6 is a side perspective view of the hair accessory and jewelry organizer according to an embodiment of the present invention.
Figure 7:
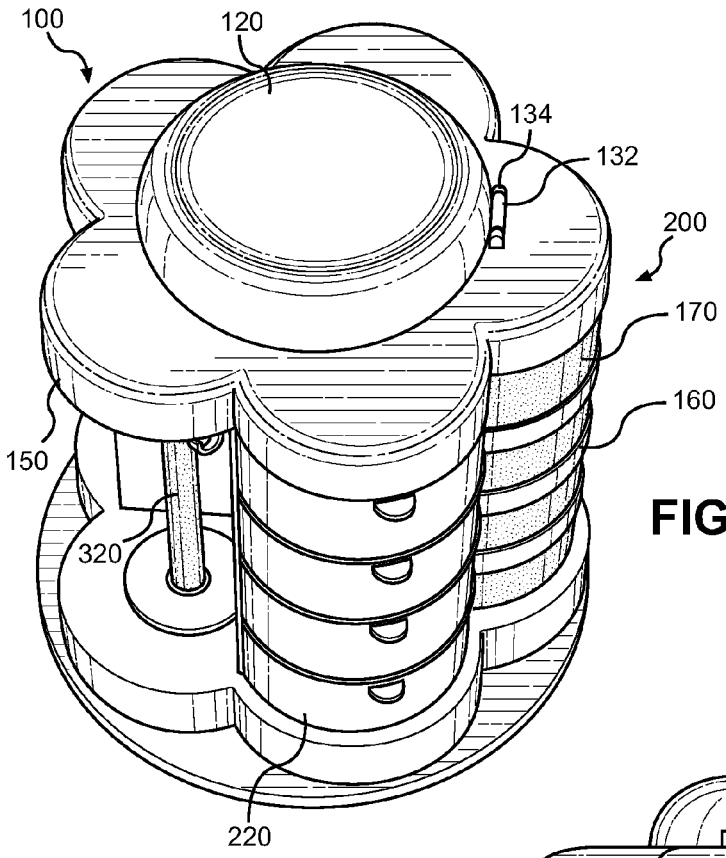
FIG. 7 is a top perspective view of the hair accessory and jewelry organizer according to an embodiment of the present invention.

FIG. 5 shows the hair accessory and jewelry organizer with the lid 120 in an open position. The lid is shown to be approximately 90 degrees relative to the top surface of the main body, but may be opened to a position greater or less than 90 degrees. In addition the hinge may limit the extent to which the lid can be opened as is well known in the art. A mirror 140 may also be attached to the inner surface of lid 120.

FIGS. 6-12 show another embodiment of the hair accessory and jewelry organizer of the present invention. In this embodiment one of the cylindrical columns includes a set of shelves 330 as shown in FIG. 8. The shelves may be used to store hair accessories, jewelry, or other items. In addition, the shelves may be used to support one or more drawers.

FIG. 10 shows an open cylindrical column having a set of triangular shelves with hooks 340 extending down from the front bottom edge of the shelves. The hooks provide additional storage for various hair accessories and jewelry items.

Figure 9:
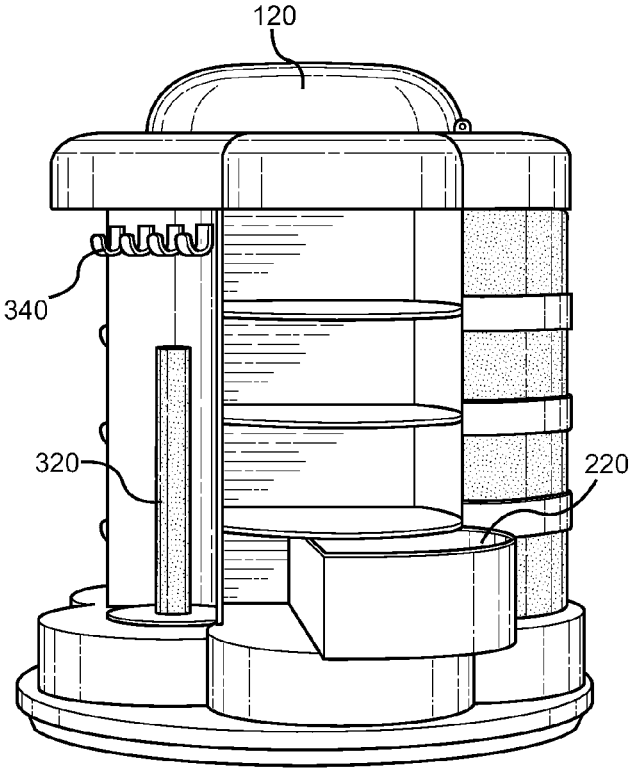
FIG. 9 is a side perspective view of the hair accessory and jewelry organizer according to an embodiment of the present invention.

A person of ordinary skill in the art will understand that one or more cylindrical columns may include one or more such shelves with hooks. In addition, a shelf with hooks may be attached proximate the ceiling of a cylindrical column, as shown in FIGS. 9 and 10.

FIG. 11 shows a bottom view of the hair accessory and jewelry organizer of the present invention. Four footpads 610 are attached to the bottom surface of a rotatable base 600, one in each quadrant. However, it should be understood that any number of footpads, or no footpads, may be attached to the bottom surface of the rotatable base in any configuration. The footpads may be made of rubber, cork, plastic, wood, metal, or other suitable material and may include a soft covering such as felt, fabric, or the like to prevent abrasive contact with a surface.

Figure 12:
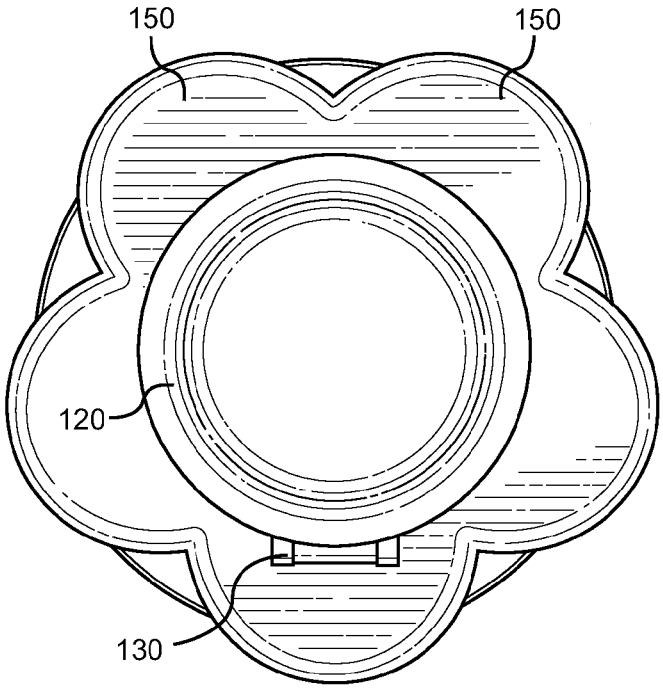
FIG. 12 is a top plan view of the hair accessory and jewelry organizer according to an embodiment of the present invention.

FIG. 12 shows a top view of the hair accessory and jewelry organizer. In this view, the flower shape of the organizer is readily apparent. The tops of each cylindrical column define petals which ring the central storage compartment. Lid 120 is shown in a closed position covering the central storage compartment 110.

FIGS. 13-18 show a further embodiment of the hair accessory and jewelry organizer. FIG. 13 is a perspective view of hair accessory and jewelry organizer with a central cavity 700. The cavity has a funnel shaped opening leading to a pentagonal shaped lower cavity. The cavity defines a slot configured to receive a compartment module 720 that is shaped to fit therein. As shown in FIG. 14, the compartment module 720 fits snugly in the slot formed by cavity 700. One of ordinary skill in the art will appreciate that cavity 700 may have any type of geometric configuration adapted to receive a complementary shaped compartment module 720.

FIG. 14 further illustrates hinge anchors 134 disposed on the rim of the compartment module 720 for receiving a horizontal hinge member 132 therebetween. In this embodiment, the top surface of main body 104 is clear of any hinge components. FIGS. 13-14 show five contiguous columns. Four of the columns are shown to be open (the rear column is out of view), with open drawer slots underneath each column.

FIG. 15 shows a bottom view of the hair accessory and jewelry organizer. In this view, the rotating base is missing in order to expose the floor 710 of central cavity 700. A plurality of fasteners 730 may be used to secure compartment module 720 to floor 710. However, one of ordinary skill will appreciate that other means may be used to secure the compartment module 720 to floor 710, such as adhesive. Alternatively, the central cavity may include one or more grooves along its inner wall for receiving a compartment module having one or more corresponding ridges along its outer surface.

Figure 16:
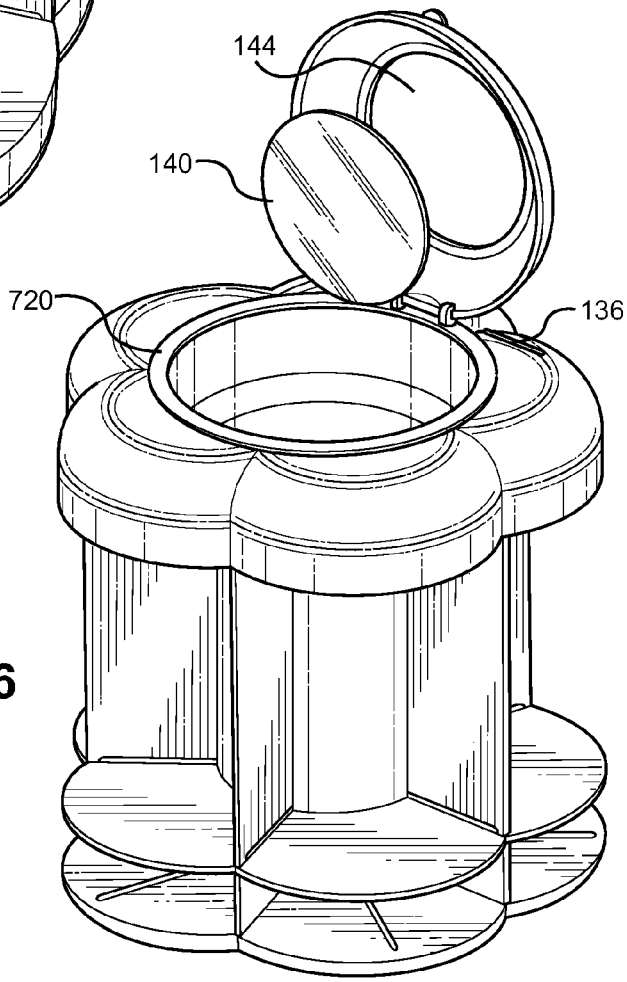
FIG. 16 is a partially exploded perspective view of the hair accessory and jewelry organizer according to an embodiment of the present invention.

FIG. 16 shows a perspective view of the hair accessory and jewelry organizer with the hinged lid 120 attached to the rim of compartment module 720. Hinge pin 136 secures horizontal hinge member 132 to hinge anchors 134. Mirror 140 may be installed in mirror receptacle 144 on the inside of lid 120.

Figure 17:
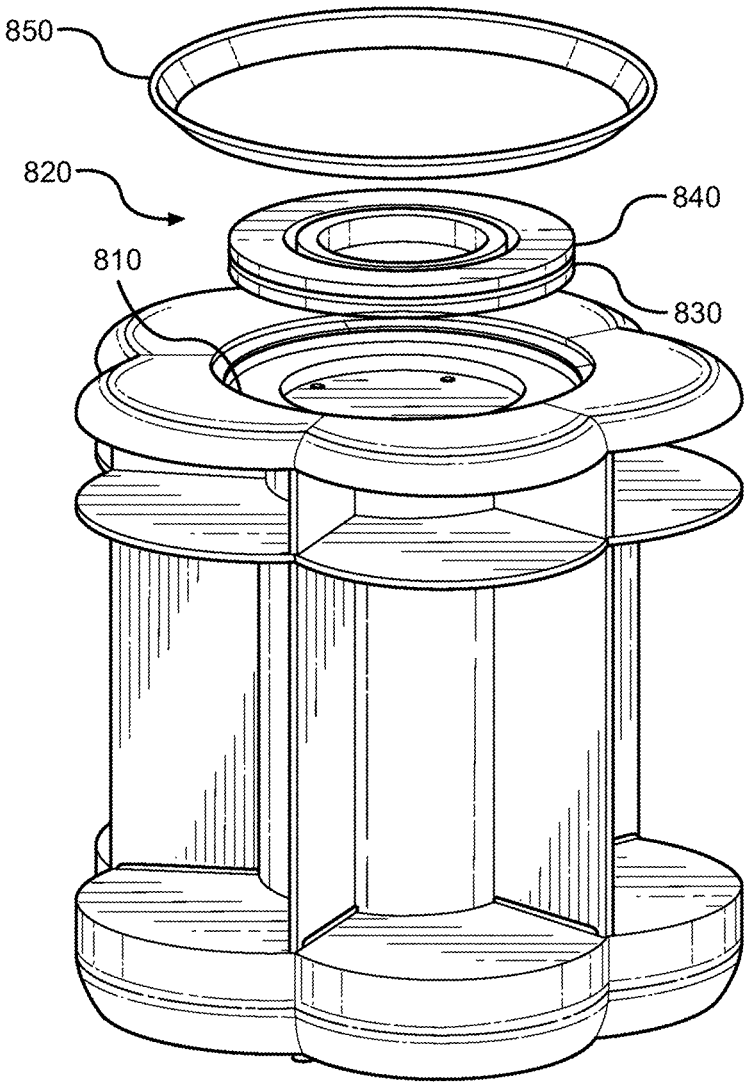
FIG. 17 is a partially exploded perspective view of the hair accessory and jewelry organizer according to an embodiment of the present invention.

FIG. 17 shows a partial exploded view of the rotating base 600. A ring-shaped seat 810 at the bottom of a circular recess is configured to receive turntable assembly 820. The turntable assembly 820 comprises at least two connected plates 830 and 840, where at least one plate can rotate relative to the other plates. A layer of material may be interposed between the plates having a low coefficient of friction. Plate 840 of turntable assembly 820 freely rotates relative to plate 830, which is affixed to the ring-shaped seat 810. A base platform 850 is attached to plate 840 of the turntable assembly. One of ordinary skill will appreciate that there are other types of turntables, or other means of rotation that could be employed to create a rotating base 600.

Figure 18:
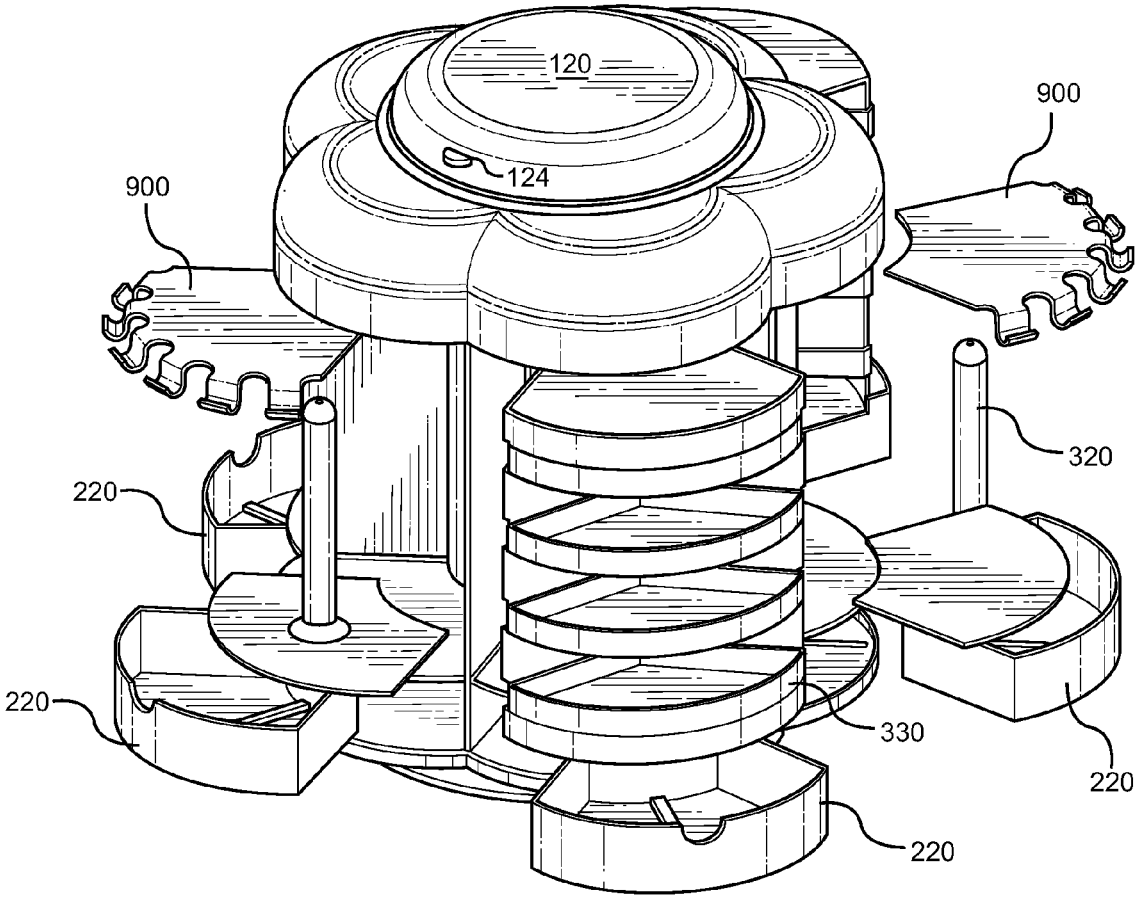
FIG. 18 is a partially exploded perspective view of the hair accessory and jewelry organizer according to an embodiment of the present invention.
Figure 19A:
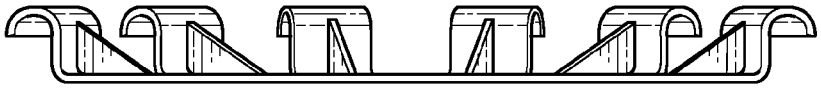
FIG. 19A is a rear elevation view of a hook plate according to an embodiment of the present invention.
Figure 19B:
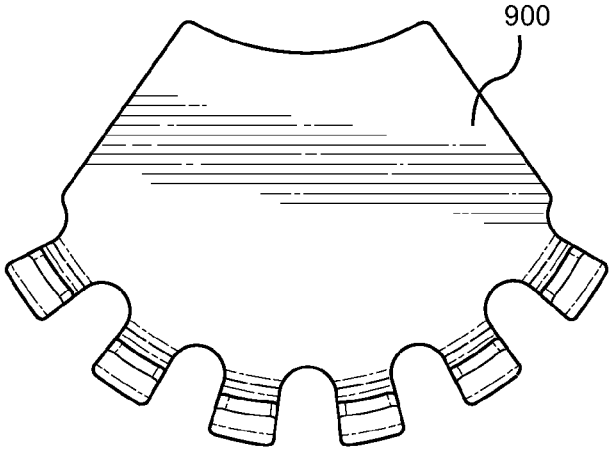
FIG. 19B is a top plan view of a hook plate according to an embodiment of the present invention.
Figure 19C:
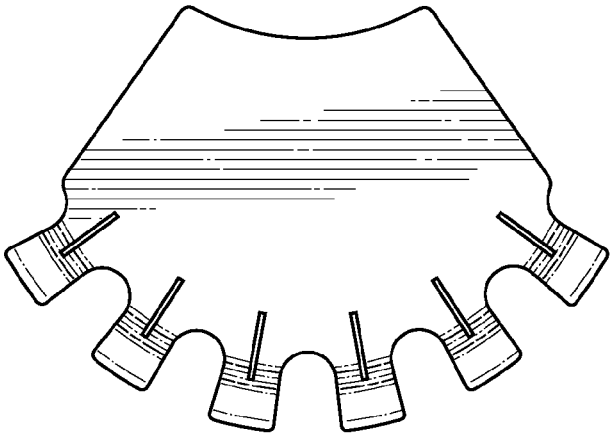
FIG. 19C is a bottom plan view of a hook plate according to an embodiment of the present invention.

FIG. 18 shows a partially exploded view of the hair accessory and jewelry organizer, with some of its constituent parts described above. FIG. 19A-C shows different views of hook plate 900.

Figure 20:
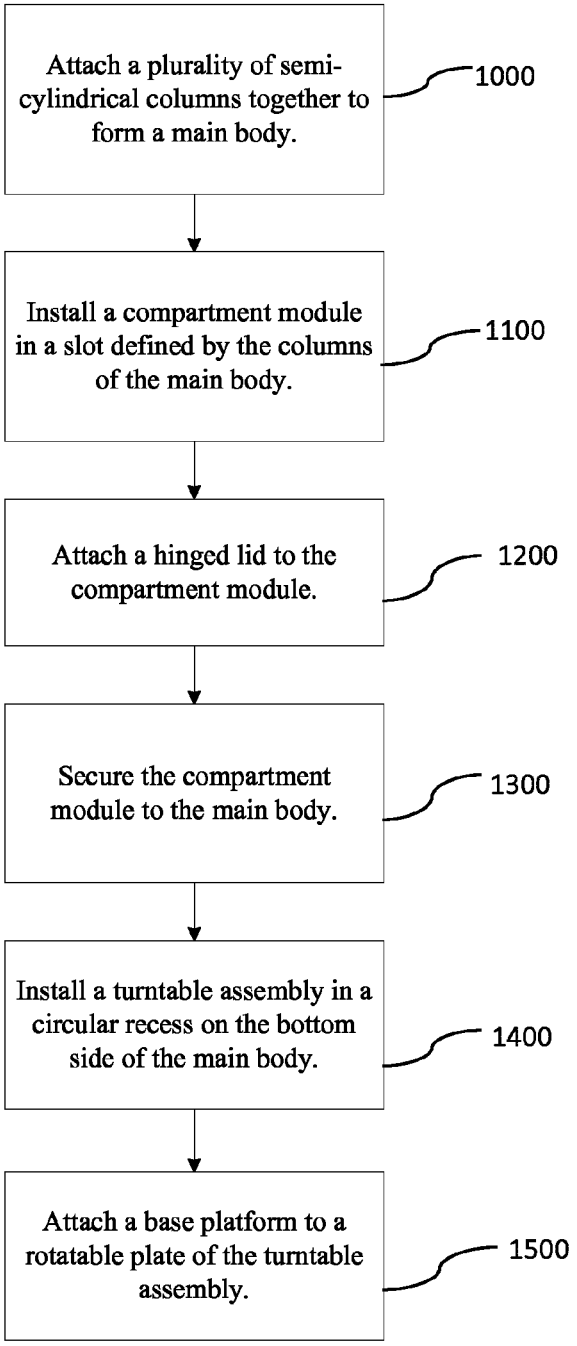
FIG. 20 is a schematic view of a method of assembling the embodiment shown in FIG. 14.

FIG. 20 illustrates a method of assembling the embodiment shown in FIGS. 14-19 in a modular fashion. At step 1000, each column is attached to an adjacent column until the main body portion of the organizer is formed. The columns may be attached with interlocking members on the back side of each column. Alternatively, adjacent columns may be snapped together by inserting male members into corresponding female members. Other attachment means may include spring clips, zip ties, elastic bands, and hook and loops. One of ordinary skill will appreciate that there are many possible ways to attach the columns together with embodiments of the present invention, and embodiments of the present invention are contemplated for use with any appropriate means of attachment.

The attached columns define a central cavity 700. The central cavity in turn defines a slot. Although, the embodiment shown in FIGS. 14-19 shows five columns forming the main body, one of ordinary skill will recognize that a different number of columns may be used to form the main body. Furthermore, one of ordinary skill will appreciate that the columns may have a different shape besides semi-cylindrical. For example, the columns may have a regular or irregular polygon, or star-shaped vertical cross-section.

At step 1100, the compartment module 720 is installed in the slot formed by central cavity 700. FIG. 15 shows the compartment module 720 fully installed. At step 1200, a hinged lid is attached to the compartment module. The hinged lid includes lid 120 and hinge assembly 130. At step 1300 the compartment module 720 is secured to the main body 104 by fastening the bottom of compartment module 720 to the floor of central cavity 700 with fasteners 730 as shown in FIG. 15.

At step 1400, the turntable assembly is installed in the circular recess on the bottom side of the main body. More specifically, plate 830 of the turntable assembly 820 is affixed to a ring-shaped seat 810 at the bottom of the circular recess. Plate 830 may be affixed to the ring-shaped seat with adhesive, bonding agent, or some other affixing means known in the art. At step 1500, a platform 850 is attached to rotatable plate 840 of turntable assembly 820.

Additional steps may include installing a mirror 140 in mirror receptacle 144 on the inside of the hinged lid 120. The mirror may be affixed to the mirror receptacle with an adhesive, a bonding agent, or some other affixing means known in the art.

At least some components of the hair accessory and jewelry organizer may be made of a polymer material such as plastic and may be formed by an injection molding process. Other suitable materials such as metal, rubber, wood, may also be used for component parts in the hair accessory and jewelry organizer.

It is to be understood that the present invention is not limited to the embodiments described above.

What is claimed is:

1. A receptacle for storing and organizing hair accessories and jewelry comprising:

a main body with a rotatable base, said main body comprising a plurality of contiguous cylindrical columns extending from said base, wherein said cylindrical columns are radially symmetrical about a central vertical axis, wherein one or more of said cylindrical columns include one or more chambers, where at least one of said contiguous cylindrical columns is covered with cushioned felt, wherein one or more elastic bands are wrapped around at least one contiguous cylindrical column, wherein the tops of said contiguous cylindrical columns define the top of said main body, wherein, the tops of said contiguous cylindrical columns further define a periphery of semi-circular caps, wherein said semi-circular caps define a central chamber between them; and a hinged lid pivotally attached to the top of said main body, proximate an edge of said central chamber.

2. The receptacle of claim 1, wherein the top of said main body has the shape of a flower head.

3. The receptacle of claim 1, wherein at least one of said contiguous cylindrical columns comprises one or more shelves disposed within a chamber thereof.

4. The receptacle of claim 1, wherein at least one of said contiguous cylindrical columns comprises one or more hooks disposed within a chamber thereof.

5. The receptacle of claim 4, wherein said one or more hooks are suspended from the ceiling of said contiguous cylindrical column.

6. The receptacle of claim 4, wherein said one or more hooks are attached to a wall of said contiguous cylindrical column.

7. The receptacle of claim 1, wherein at least one of said contiguous cylindrical columns comprises a vertical pole extending from a floor thereof.

8. The receptacle of claim 1, wherein the hinged lid comprises a mirror affixed to its inner surface.

9. The receptacle of claim 1, wherein at least one of said contiguous cylindrical columns comprises one or more drawers.

10. The receptacle of claim 1, wherein the hinged lid comprises a finger catch for opening or closing said lid.

* * * * *